US005857985A

United States Patent [19]

Feng

[11] Patent Number: 5,857,985

[45] Date of Patent: Jan. 12, 1999

[54] MULTIFUNCTIONAL HEALTH MASSAGE DEVICE

[76] Inventor: Hsiu-Mei Feng, F1. 4, No. 59-1, Tsao-Di-Wei, Shen-Keng Hsiang, Taipei Hsien, Taiwan

[21] Appl. No.: 848,273

[22] Filed: Apr. 29, 1997

[51] Int. Cl.[6] ..... A61H 1/00

[52] U.S. Cl. ..... 601/47; 601/57; 601/46

[58] Field of Search ..... 601/46–8, 57–60, 601/70, 78

[56] References Cited

U.S. PATENT DOCUMENTS

| | | | |
|---|---|---|---|
| 3,854,474 | 12/1974 | Carruth | 601/49 |
| 4,354,067 | 10/1982 | Yamada et al. | 601/58 X |
| 4,779,615 | 10/1988 | Frazier | 601/47 |
| 5,422,710 | 6/1995 | Komatsu | 601/47 X |

FOREIGN PATENT DOCUMENTS

| | | | |
|---|---|---|---|
| 3237427 | 4/1984 | Germany | 601/47 |
| 360204194 | 10/1985 | Japan | 601/47 |

*Primary Examiner*—Danton D. DeMille
*Attorney, Agent, or Firm*—Bacon & Thomas

[57] ABSTRACT

A multifunctional health massage device includes a fixing frame enclosed within an elastic material, and an oscillating device installed on the frame. A control switch is installed on a panel situated on said elastic material, the control switch being arranged to switch between an audio control mode in which a strength of oscillations of said massager is controlled by an audio signal input through an audio input jack, and an internal signal control mode in which the oscillating device is caused to oscillate in response to an internal fixed or variable internal signal source. The control panel is removable to enable remote control of the massager when used to massage a user's back or other inaccessible body part, and an audio output jack is provided so that the user can listen to music while using the device.

10 Claims, 6 Drawing Sheets

MULTIFUNCTIONAL HEALTH MASSAGE DEVICE

BACKGROUND OF THE INVENTION

The present invention relates to a multifunctional health massage device, and especially to a massage device which may be controlled by an input audio signal so as to provide different oscillating frequencies. The massage device of the invention is suited to massage the human body.

DESCRIPTION OF THE PRIOR ART

In a known foot or lower leg massage device, a plurality of rolling axles with convex portions are installed, and the rolling axles are pivotally connected with the chassis of the device, with a motor also installed within the case of the device. In general, the rolling axles are driven as the driving motor of this massage device is rotated, and the convex portions on the rolling centers contact with the lower leg or foot so that the lower leg or foot and acupoints are massaged.

In another massage device, a chassis is installed, and two outwardly extruded bars are installed on the chassis, while a motor is installed within the chassis, while a motor is installed within the chassis, but such kind massage device is often installed within the back of a chair. During use the two bars are moved circularly and the chassis is moved upwards and downwards by the back of chair, thus enlarging the massaging area of the massage device the two prior massage devices are limited in that they can only be used to massage specified local portions of human body, the range of usage is small and the strength of massage is difficult to adjust, so just a single frequency is used. Therefore, said devices are not ideal.

In response, the inventor of the present invention has made some improvements to the massage device of the prior art, and a multifunctional health device is provided. Using a convertible control switch and the propagation of music, the strength of the massage device may be adjusted according to the frequencies of the music, and the user may hear music during massaging.

SUMMARY OF THE INVENTION

Accordingly, it is an object of the present invention to provide a multifunctional health massage device which may be used on different portions of a human body.

Another object of the present invention is to provide a multifunctional health massage device which may be switched to an audio control mode so that the strength of the massage device is adjusted by the frequencies of music.

A further object of the present invention is to provide a multifunctional health massage device which allows the user to hear music during a massage.

In order to attain the objects of the present invention, a fixing frame is enclosed by an elastic material, an oscillating means is installed on said frame, and the control switch of the oscillating device is installed on the panel of the elastic material. The control switch may be switched to an audio control mode, causing the oscillating device to be controlled by music frequencies, and therefore the oscillating device may provide massages with different strengths. In addition the user may hear music during massaging.

The invention, as well as its many advantages, may be further understood by the following description and drawings in which:

DETAILED DESCRIPTION OF THE PREFERRED EMBODIMENT

Figure 1:
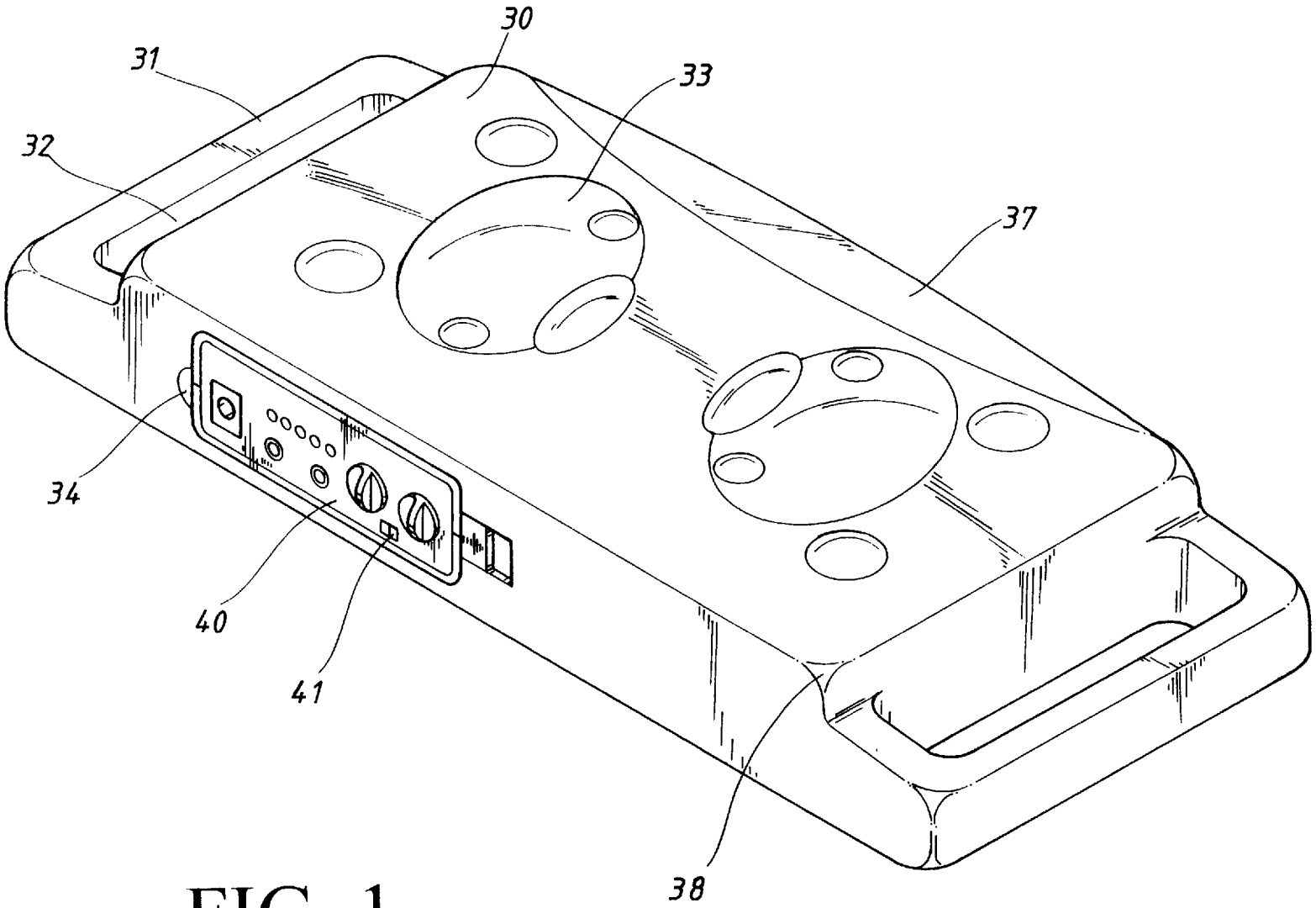
FIG. 1 is a perspective view of a preferred embodiment of the present invention.
Figure 2:
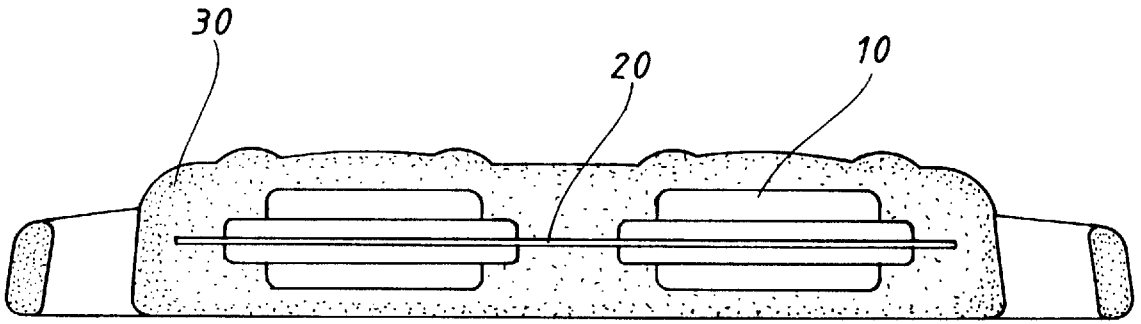
FIG. 2 is a cross sectional view of the preferred embodiment of the present invention.

Now referring to FIGS. 1 and 2, the oscillating device 10 of the present invention is fixedly secured on a fixing frame 20, and sealed within an elastic material 30 to which a control plate 40 is installed.

Figure 3:
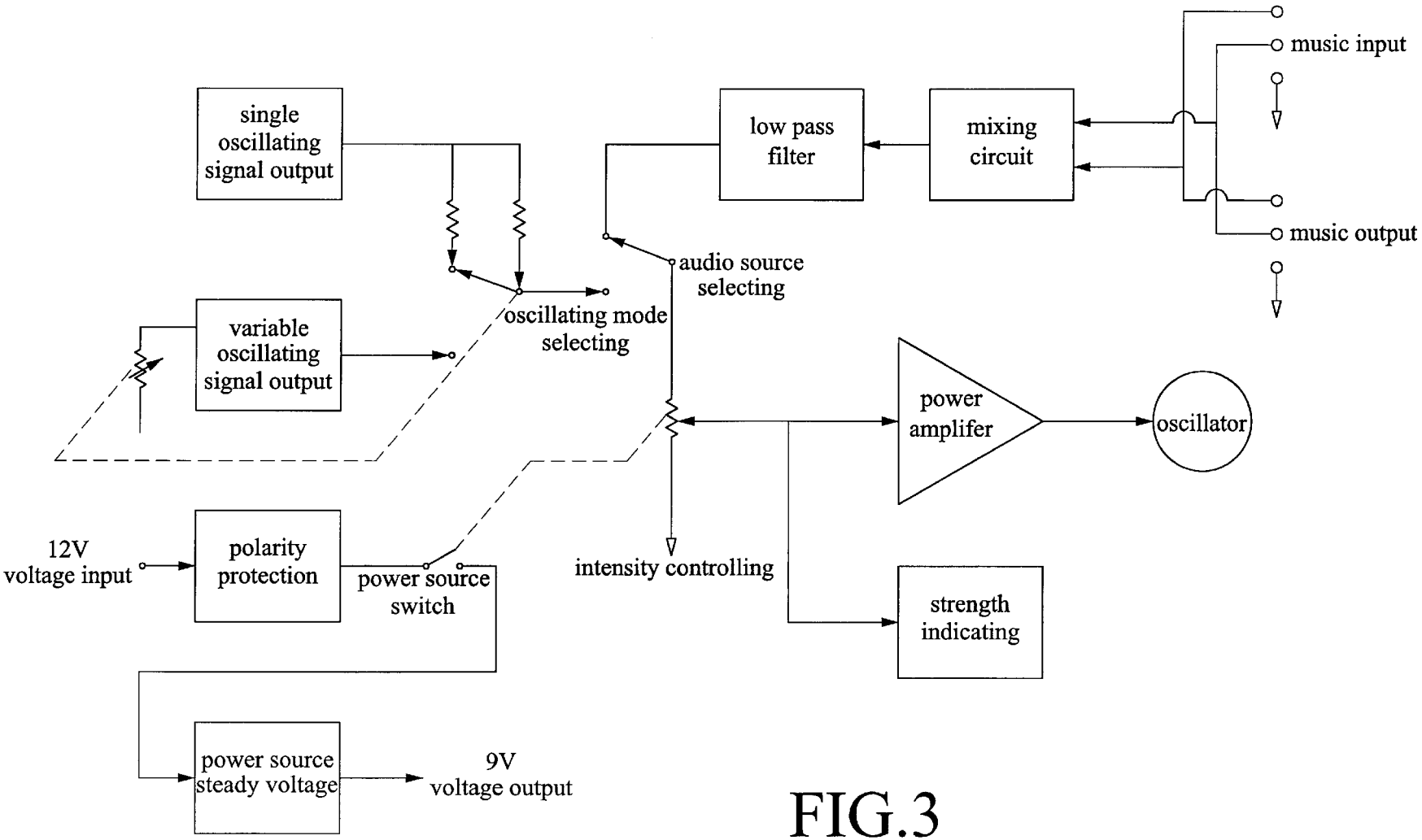
FIG. 3 is a schematic diagram of a circuit used in the preferred embodiment of the present invention.
Figure 4A:
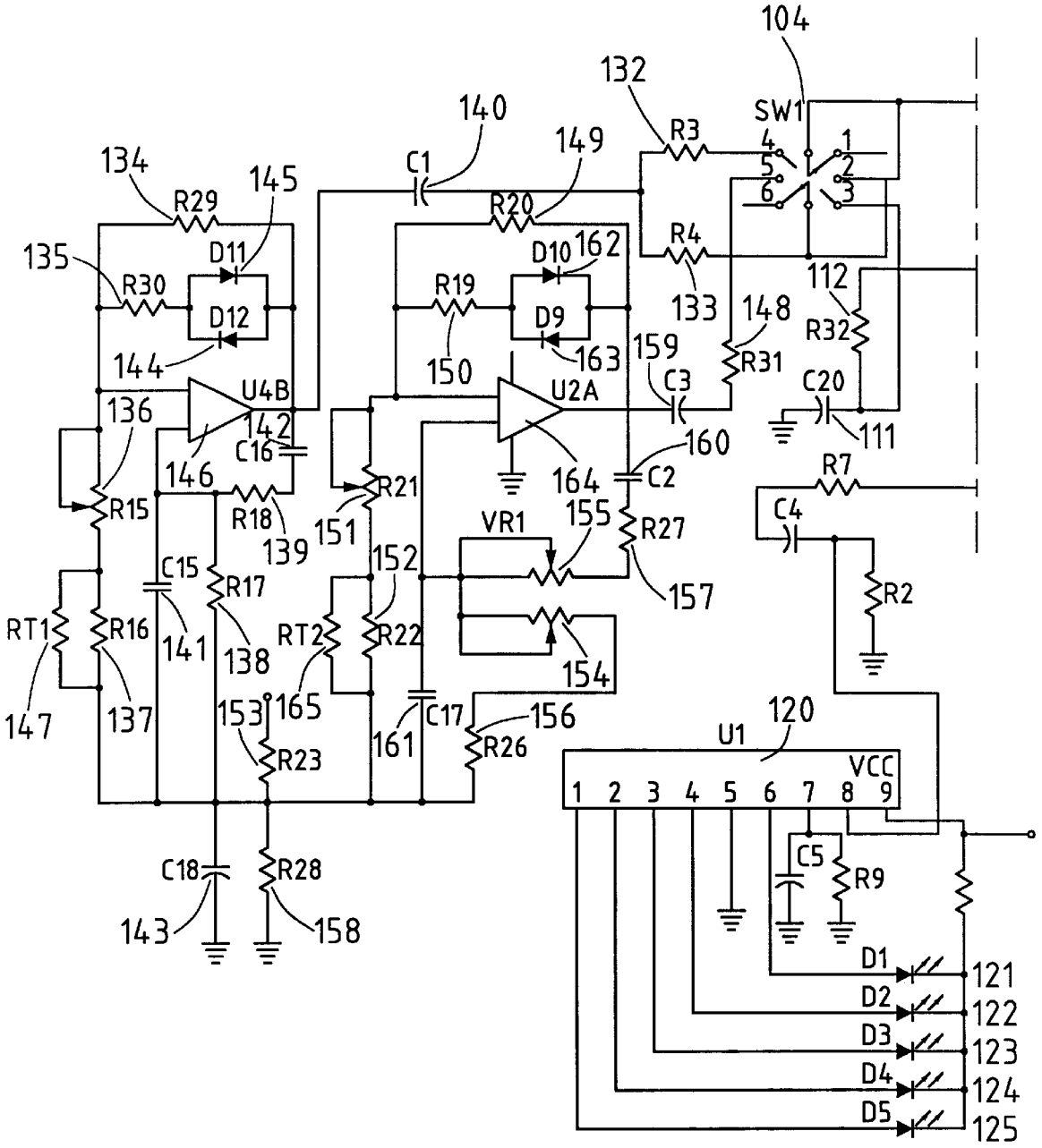
FIGS. 4A and 4B are detailed circuit diagram of the circuit shown in FIG. 3.
Figure 4B:
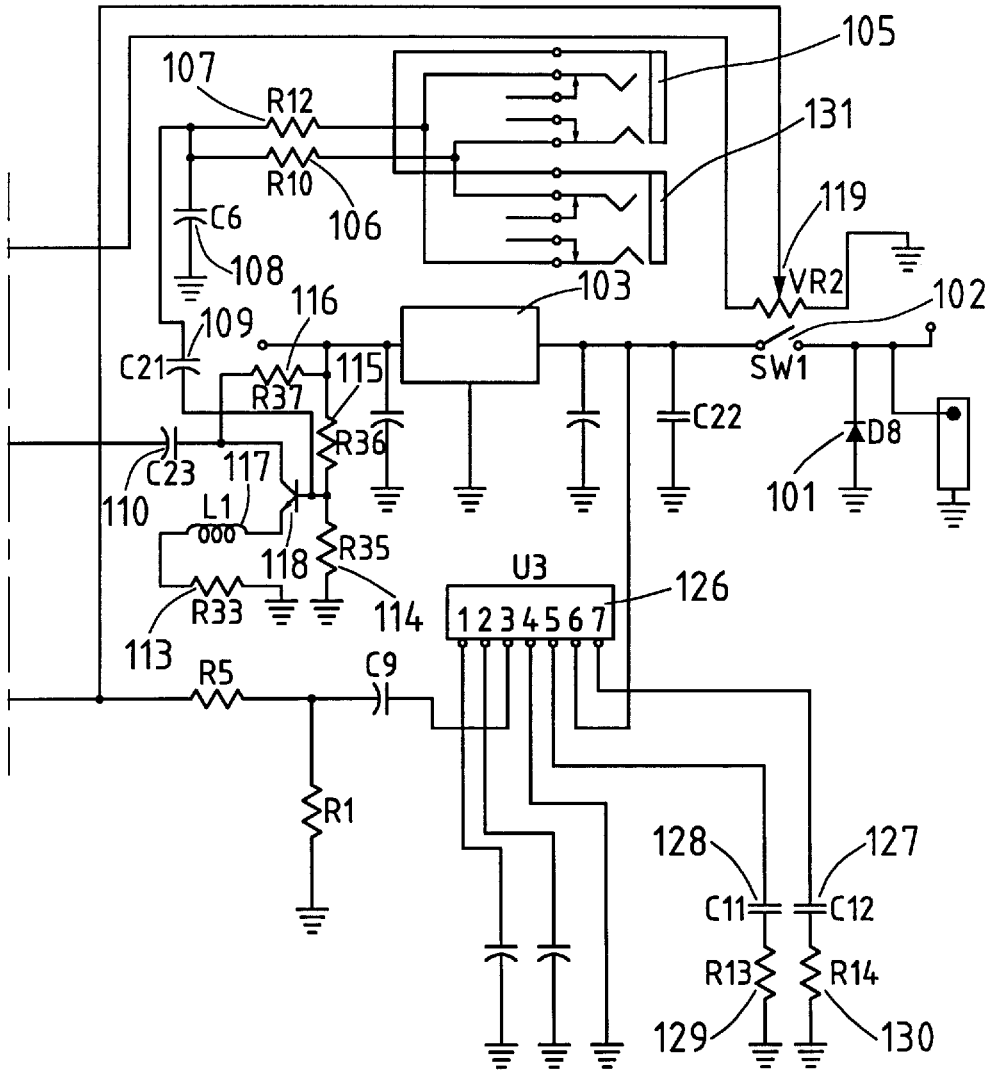

FIGS. 3, 4A, and 4B, and especially FIGS. 4A and 4B show the circuit of the oscillating device 10 which is connected with a power source of 12V. Voltage is passed through the diode of a polarity protecting device D8 to power source switch 102. When power source switch 102 is on, IC 103 supplies a steady voltage output of 9V. Now two cases may be selected:

(1) One side of bi-directional switch 104 is switched to a position of 3 to provide an audio source mode, and another side of switch 104 is switched to position 6. The music is input from any audio signal source plugged into an input jack 105 (audio in) through a mixing circuit which is formed by resistors 106 and 107, and capacitors 108, low pass filters which are formed by capacitors 109, 110, 111 and respectively, resistors 112, 113, 114, 115, and 116, and through inductor 117, and transistor 118. Variable resistor 119 of VR2 adjusts the magnitude of the audio signal while IC 120 energizes display LEDs 121, 122, 123, 124, and 125 and an oscillator power supply formed by the capacitors 127 and 128 and, respectively, resistors 129 and 130 to control strength of oscillation of the massager is also driven by the power amplifier 126 according to the frequency of the audio signal. An audio output jack 131 allows the user to plug in earphones and hear music during massaging.

(2) One side of the bi-directional switch 104 is switched to the signal mode 2, and the other side is selected to be in an oscillating mode, for which there are two possibilities:

1. When the switch is switched to position of 4, a single signal output is provided by resistors 132, 133, 134, 135, 136, 137, 138, and 139, capacitors 140, 141, 142, and 143, diodes 144 and 145, operational amplifier 146, and resistor 147. Then, the variable resistor 119 drives the power amplifier 126 according to a single oscillating signal so that the strength of oscillation and the LED indicators are controlled by the single signal.
2. When the switch is switched to 5, an oscillating output signal is provided by resistors 148, 149, 150, 151, 152, 153, 154, 155, 156, 157, and 158, capacitors 159, 160, 161, diodes 162 and 163, operational amplifier 164, and resistor 165. Then, the variable resistor 119 is driven so as to vary the frequency of the oscillation signal, and the power amplifier 126 is driven so that the strength of oscillation and the LED indicators are varied according to the control of the oscillating signal frequency by the variable resistor 119.

Figure 5:
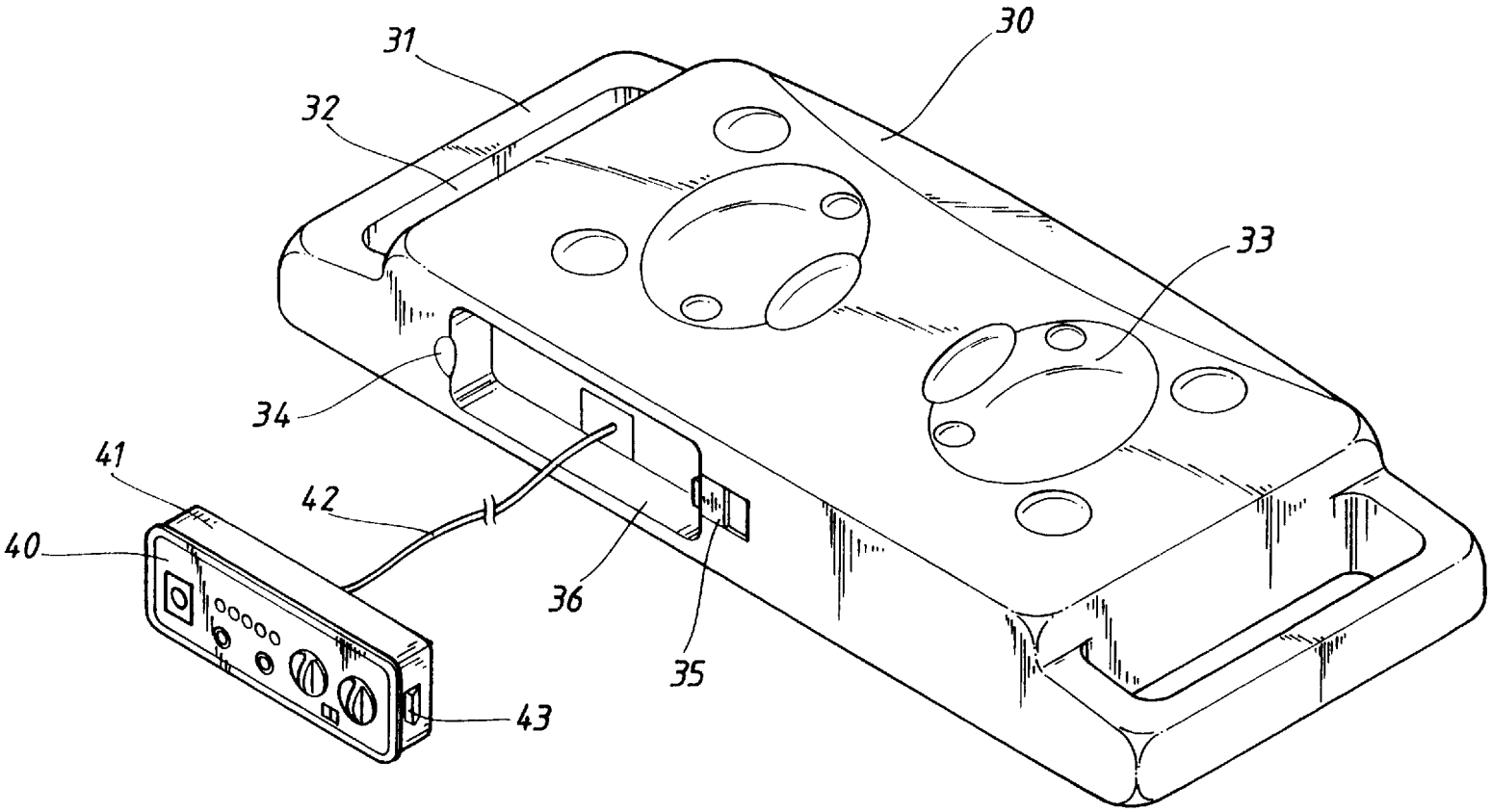
FIG. 5 is a perspective view of the preferred embodiment illustrated in FIG. 1, with the control panel removed.

Now referring to FIGS. 1 and 2, the circuit is positioned within the oscillating device 10 and then is fixed on the fixing frame 20, the whole circuit and frame being covered by an elastic material 30 to form an approximate oblong shape, the right and left side of which are installed with projecting handle portions 31, with openings 32 formed in appropriate positions at the center of the handle portions 31. Convex portions 33 are installed on the surface of the oscillating device 10, and the corners of the oblong shape are formed as an arc 38. One side which is longer than the other side is formed as a flat side including a slightly concave portion 37, and a groove 36 is installed in an appropriate position on another long side, and one side of the groove 36 is installed with a chamfered groove 34, while another side is installed with sliding latch, as shown in FIG. 5, arranged to slide forwards and backwards for latching control box 41, the rear side of which is installed with an electric wire 42 connected to the oscillating device 10, and the front end thereof is installed with a control panel 40. A torque is installed on the latch to secure the control box in place.

In the preferred embodiment of FIGS. 4A and 4B if the user wishes to massage his or her back, the massage device placed on the back and accordingly, the control panel would also normally be moved to the back, and the control button could not be seen during adjusting. According to the invention, however, the latch 35 may be slid backwards and the control box separated from the massage device itself as shown in FIG. 5. Thus, when the massage device is positioned on the human body, it may be controlled directly by the control box, and the massage device may be caused to oscillate according to the action of the control box.

In summary, the multifunctional massage device of the present invention, the strength of oscillation may be controlled by an audio signal and the user may hear music during massaging, and thus the present invention is greatly improved over prior art massaging devices.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A multifunctional health massager, comprising:

a frame enclosed within an elastic material;

an oscillating device installed on said frame and also enclosed within said elastic material;

an input jack through which audio frequency signals may be input;

an internal oscillating signal source; and means for causing said oscillating device to oscillate in response to said audio frequency signals or for causing said oscillating device to oscillate in response to said internal oscillating signal source, wherein said means for causing said oscillating device to oscillate in response to said audio frequency source or said internal oscillating signal source is arranged to vary a strength of said oscillations in response to frequencies of said audio frequency source or said internal oscillating signal source.

2. A massager as claimed in claim 1, further comprising a control switch located on a control panel situated on a surface of said elastic material.

3. A massager as claimed in claim 2, further comprising means for removably securing said control panel, including said control switch, to said elastic material, in order to enable removal of said control panel from said massager, whereby said massager can be controlled by a user while being used to massage a relatively inaccessible portion of the user's body.

4. A massager as claimed in claim 1, further comprising an audio output jack, whereby a user of the massager may listen to music input through said audio input jack during a massage.

5. A multifunctional health massager, comprising:

a frame enclosed within an elastic material;

an oscillating device installed on said frame and also enclosed within said elastic material;

a control switch extending from said elastic material;

an input jack through which audio frequency signals may be input;

an internal oscillating signal source; and means for causing said oscillating device to oscillate in response to said audio frequency signals when said switch is in a first position, and for causing said oscillating device to oscillate in response to said internal oscillating signal source when said switch is in a second position.

6. A massager as claimed in claim 5, wherein said means for causing said oscillating device to oscillate in response to said audio frequency source or said internal oscillating signal source is arranged to vary a strength of said oscillations in response to frequencies of said audio frequency source or said internal oscillating signal source.

7. A massager as claimed in claim 5, wherein said internal oscillating signal source includes a fixed frequency oscillator and a variable frequency oscillator.

8. A massager as claimed in claim 5, wherein said switch is located on a control panel situated on a surface of said elastic material.

9. A massager as claimed in claim 8, further comprising means for removably securing said control panel, including said switch, to said elastic material, in order to enable removal of said control panel from said massager, whereby said massager can be controlled by a user while being used to massage a relatively inaccessible portion of the user's body.

10. A massager is claimed in claim 5, further comprising an audio output jack, whereby a user of the massager may listen to music input through said audio input jack during a massage.

* * * * *